US009112295B2

(12) United States Patent
Smith, Jr. et al.

(10) Patent No.: US 9,112,295 B2
(45) Date of Patent: Aug. 18, 2015

(54) MODULAR ELECTRICAL CONNECTOR AND CONNECTION METHOD

(71) Applicant: Robert Bosch GmbH, Stuttgart (DE)

(72) Inventors: Daniel E. Smith, Jr., Brighton, MI (US); Paul Mason, Dearborn, MI (US); David Toutant, Grosse Pointe Woods, MI (US)

(73) Assignee: Robert Bosch GmbH, Stuttgart (DE)

( * ) Notice: Subject to any disclaimer, the term of this patent is extended or adjusted under 35 U.S.C. 154(b) by 14 days.

(21) Appl. No.: 13/789,859

(22) Filed: Mar. 8, 2013

(65) Prior Publication Data

US 2014/0017922 A1 Jan. 16, 2014

Related U.S. Application Data

(60) Provisional application No. 61/671,190, filed on Jul. 13, 2012.

(51) Int. Cl.

| | |
|---|---|
| ***H01R 13/502*** | (2006.01) |
| ***H01R 13/46*** | (2006.01) |
| ***H01R 13/514*** | (2006.01) |
| ***H01R 13/53*** | (2006.01) |
| *H01R 13/436* | (2006.01) |
| *H01R 13/506* | (2006.01) |

(52) U.S. Cl.

CPC ..... *H01R 13/46* (2013.01); *H01R 13/514* (2013.01); *H01R 13/53* (2013.01); *H01R 13/4367* (2013.01); *H01R 13/506* (2013.01)

(58) Field of Classification Search

CPC ..... H01R 13/514
USPC ..... 439/701, 686, 752
See application file for complete search history.

(56) References Cited

U.S. PATENT DOCUMENTS 3,534,325 A 10/1970 Jullien-Davin
3,670,295 A 6/1972 Ege et al.

(Continued)

FOREIGN PATENT DOCUMENTS

EP 0923164 A2 6/1999
EP 1724880 A1 11/2006

(Continued)

OTHER PUBLICATIONS

Robert Bosch Corporation 2-pin pump flange terminal connector part No. 6002KP0102, known and accessible to the public at least prior to Jul. 13, 2011, as illustrated and described in the accompanying drawing and statement of relevance, 2 pages.

(Continued)

*Primary Examiner* — Phuong Dinh
(74) *Attorney, Agent, or Firm* — Michael Best & Friedrich LLP

(57) ABSTRACT

An electrical connector for a modular electrical connection assembly for a fuel system includes a first leg portion and an adjacent second leg portion, each leg portion defining a cavity. The cavity of the first leg portion is configured to receive and maintain a first connector terminal and the cavity of the second leg portion is configured to receive and maintain a second connector terminal without the use of a seal fluidly separating the first connector terminal from the second connector terminal. The first connector terminal and the second connector terminal are concurrently operable with the fuel system.

17 Claims, 7 Drawing Sheets

(56) References Cited

U.S. PATENT DOCUMENTS

| | | | | |
|---|---|---|---|---|
| 4,828,506 | A | 5/1989 | Tuckwood | |
| 5,026,304 | A * | 6/1991 | Furrow | 439/595 |
| 5,391,062 | A | 2/1995 | Yoshioka | |
| 5,407,363 | A | 4/1995 | Polgar et al. | |
| 5,967,859 | A * | 10/1999 | Cecil et al. | 439/752 |
| 6,030,242 | A | 2/2000 | Cunningham et al. | |
| 6,773,271 | B2 * | 8/2004 | Falchetti | 439/76.2 |
| 6,877,373 | B2 | 4/2005 | Gilmour et al. | |
| 7,553,199 | B2 | 6/2009 | Correll | |
| 7,618,262 | B2 | 11/2009 | Fogg et al. | |
| 7,892,048 | B2 * | 2/2011 | Shi et al. | 439/752 |
| 2008/0020639 | A1 | 1/2008 | Ichio | |
| 2011/0053403 | A1 | 3/2011 | Tsuruta et al. | |

FOREIGN PATENT DOCUMENTS

| | | | |
|---|---|---|---|
| EP | 2023445 | A2 | 2/2009 |
| EP | 2302745 | A1 | 3/2011 |
| GB | 2108331 | A | 5/1983 |
| GB | 2156711 | | 10/1985 |
| JP | 2005276574 | A | 10/2005 |

OTHER PUBLICATIONS

Delphi Corporation terminal part No. 12066214, known and accessible to the public at least prior to Jul. 13, 2011, retrieved from the Internet at: http://delphi.com/connectors/product/view/12066214, 2 pages.

Pepperl + Fuchs, Engineer's Guide, 90 pages.

PCT Search Report and Written Opinion for Application No. PCT/US2013/048850, dated Sep. 24, 2013, 14 pages.

* cited by examiner

MODULAR ELECTRICAL CONNECTOR AND CONNECTION METHOD

BACKGROUND

The present invention relates to a modular electrical connector for connecting electrical and electronic components in a fuel supply module, for example, within a fuel tank of a vehicle fuel system.

Vehicle fuel systems are manufactured to contain and distribute fuel, such as gasoline or ethanol, and to properly monitor various fuel parameters during vehicle operation. As a result, fuel systems include multiple sensors and detectors requiring effective electrical connections within the fuel tank of the system.

SUMMARY

Sealing the electrical connector assemblies is an intensive and expensive manufacturing solution to preclude electrical arcing between terminals. Alternatively, a connector constructed to maintain a minimum charge separation distance between terminals, without the need for seals and while accommodating modular architecture, provides for a more flexible, less expensive manufactured assembly for fuel system operation free from arcing concerns.

In one embodiment of a modular electrical connector assembly for a fuel supply module, the assembly includes an electrical connector having a first leg portion defining a first cavity configured to receive a first connector terminal having a first terminal end, and a second leg portion adjacent to the first leg portion. The second leg portion defines a second cavity configured to receive a second connector terminal having a second terminal end. The connector further has a surface separating the first cavity from the second cavity and defines a plane coincident therewith. The assembly further includes a receptacle including a body having one or more cells formed to receive the electrical connector. When the first connector terminal is disposed within the first cavity and the second connector terminal is disposed within the second cavity, twice a shortest distance A from one of the first and second terminal ends to the plane plus a shortest distance B along the plane between the first connector terminal and the second connector terminal is no less than a predetermined distance.

In one embodiment of a modular electrical connector assembly for a fuel supply module, the assembly includes an electrical connector having a first leg portion defining a first cavity configured to receive a first connector terminal having a first exposed terminal surface, and a second leg portion adjacent to the first leg portion. The second leg portion defines a second cavity configured to receive a second connector terminal having a second exposed terminal surface. A receptacle includes a body having one or more cells formed to receive the electrical connector. When the first connector terminal is disposed within the first cavity and the second connector terminal is disposed within the second cavity the most direct fluid path between the first exposed terminal surface and the second exposed terminal surface is no less than 15 mm.

In one embodiment of an electrical connector for a modular electrical connection assembly for a fuel system, the connector includes a first leg portion and an adjacent second leg portion, each leg portion defining a cavity. The cavity of the first leg portion is configured to receive and maintain a first connector terminal and the cavity of the second leg portion is configured to receive and maintain a second connector terminal without the use of a seal fluidly separating the first connector terminal from the second connector terminal. The first connector terminal and the second connector terminal are concurrently operable with the fuel system.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. And as used herein and in the appended claims, the terms "upper", "lower", "top", "bottom", "front", "back", and other directional terms are not intended to require any particular orientation, but are instead used for purposes of description only.

Figure 1:
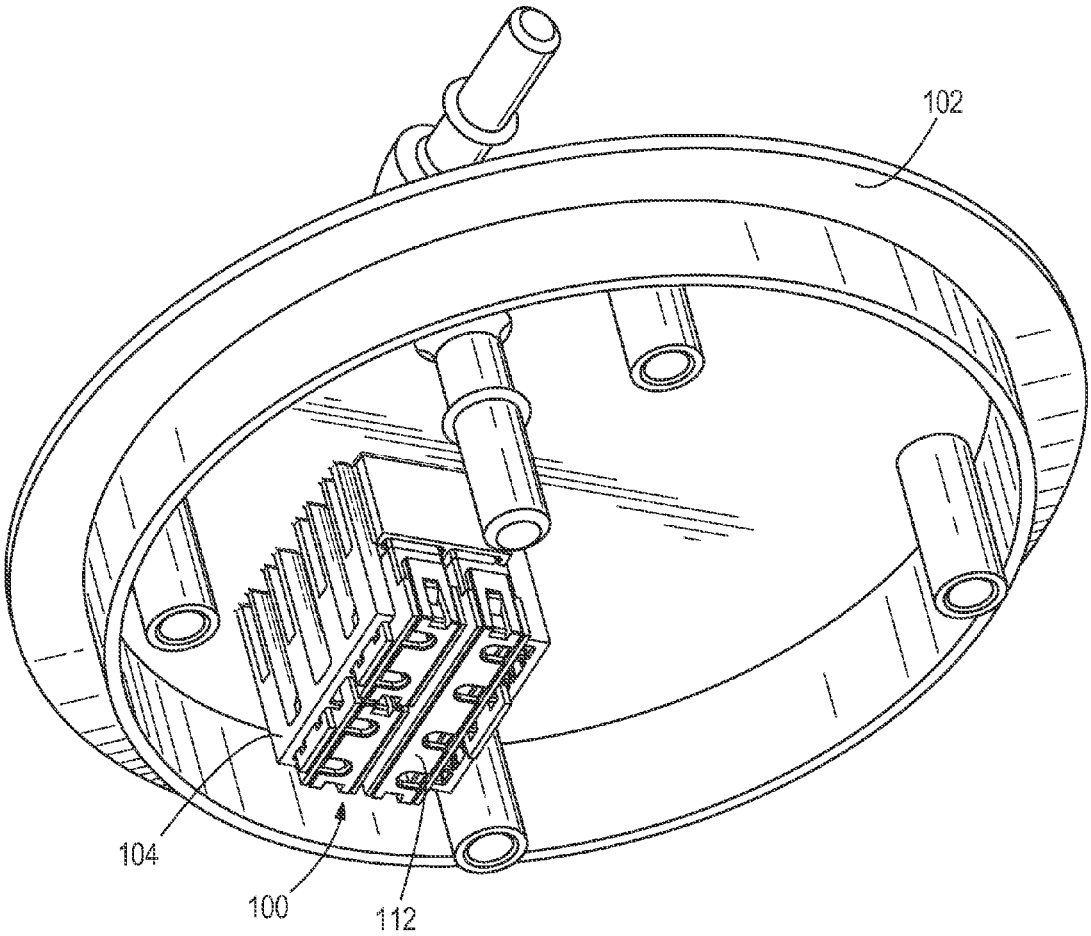
FIG. 1 is a perspective view of a fuel tank flange with a modular connector assembly.
Figure 2:
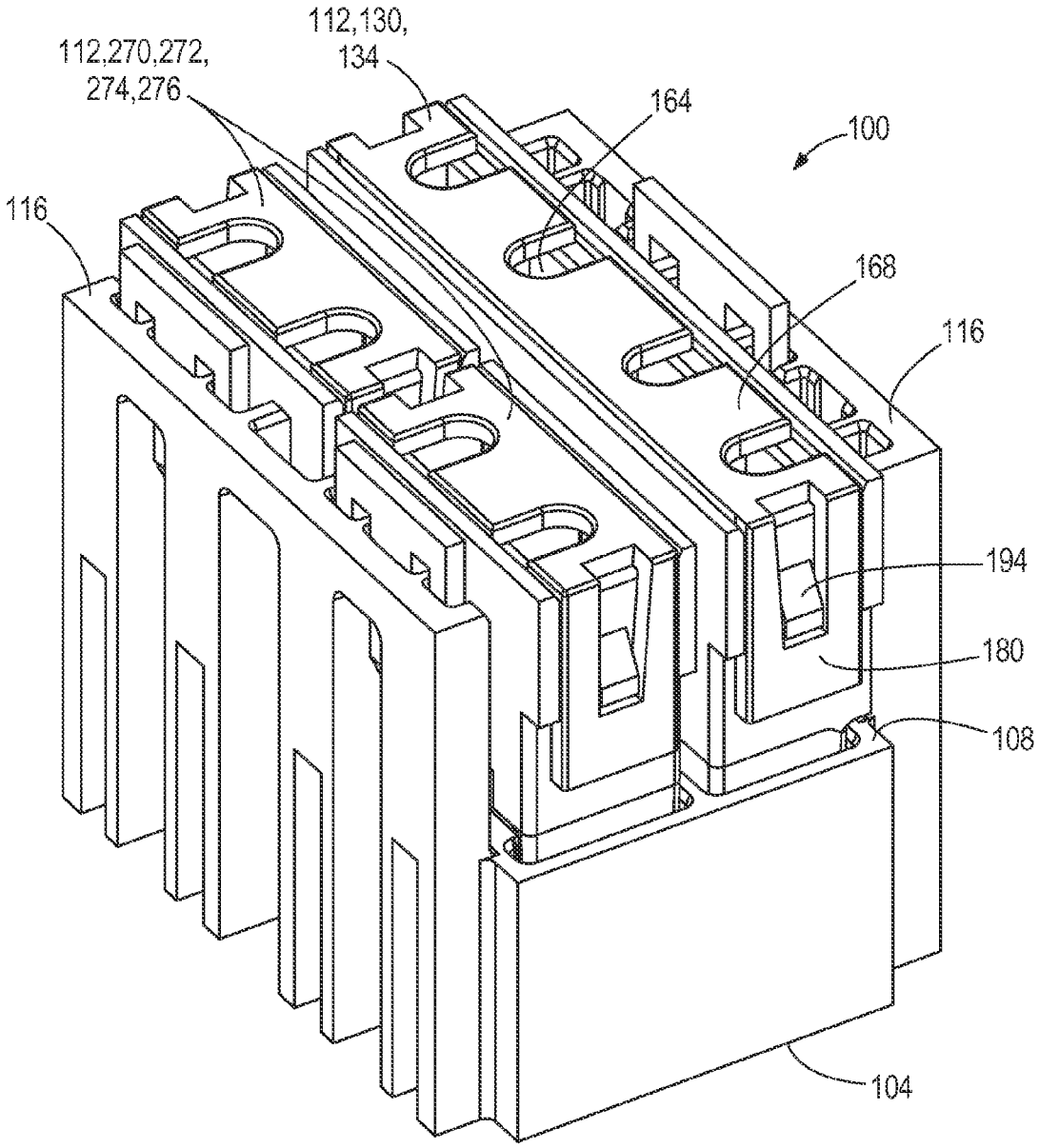
FIG. 2 is a perspective view of the modular connector assembly illustrated in FIG. 1.

FIG. 1 illustrates a modular connector assembly 100 for making electrical and electronic connections between components used in a vehicle fuel tank. The fuel tank (not shown) is constructed with a flange 102 (part of the fuel supply module assembly) that seals the tank from the outside and provides an attachment point for various components of the fuel system including connections for the fuel line(s) and instruments, i.e., sensor and detectors, used to monitor fuel system parameters and performance. Referring to FIG. 2, the connector assembly 100 includes a receptacle or pocket 104 having a pocket body 108 for receiving one or more electrical connectors (generically referenced 112 in FIG. 2) and opposing pocket retainer members 116 for securing the connectors 112 in place. The pocket 104, further detailed below, is manufactured with the fuel tank flange 102 and can be, for example, molded in the underside of the flange or otherwise formed as a part of the flange, as shown in FIG. 1. The connectors 112 permit electrical connection to or from the aforementioned instruments and are preferably each configured as a 4-pin connector or a 2-pin connector.

Figure 3:
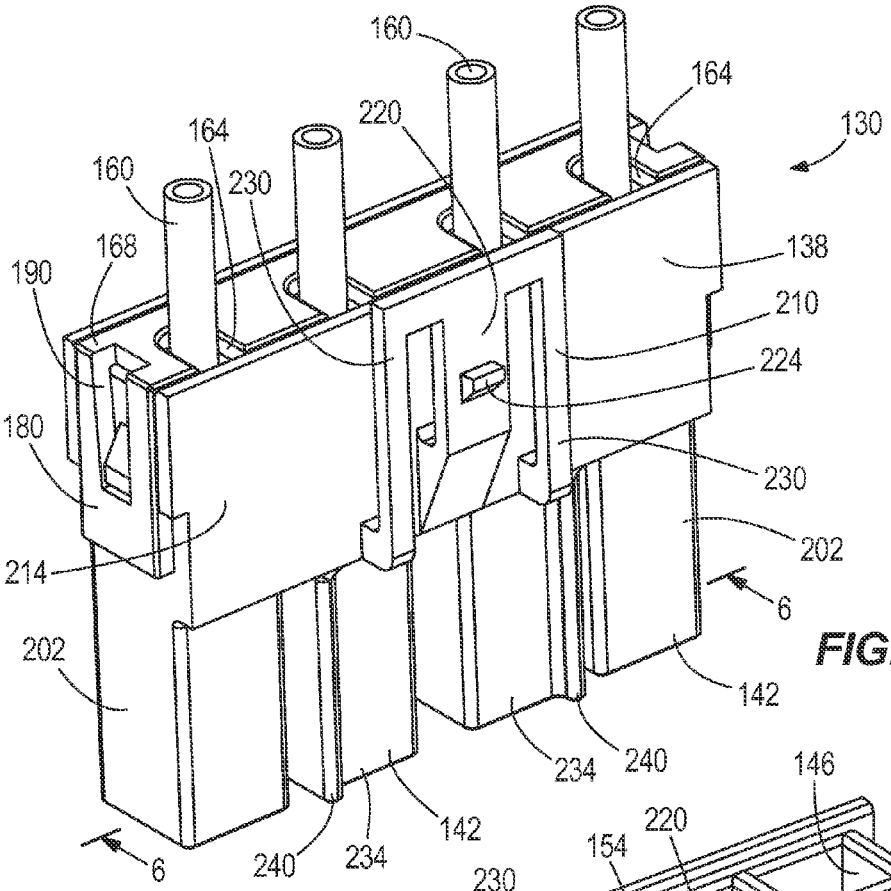
FIG. 3 is a perspective view of a 4-pin connector of the modular connector assembly of FIG. 2.
Figure 4:
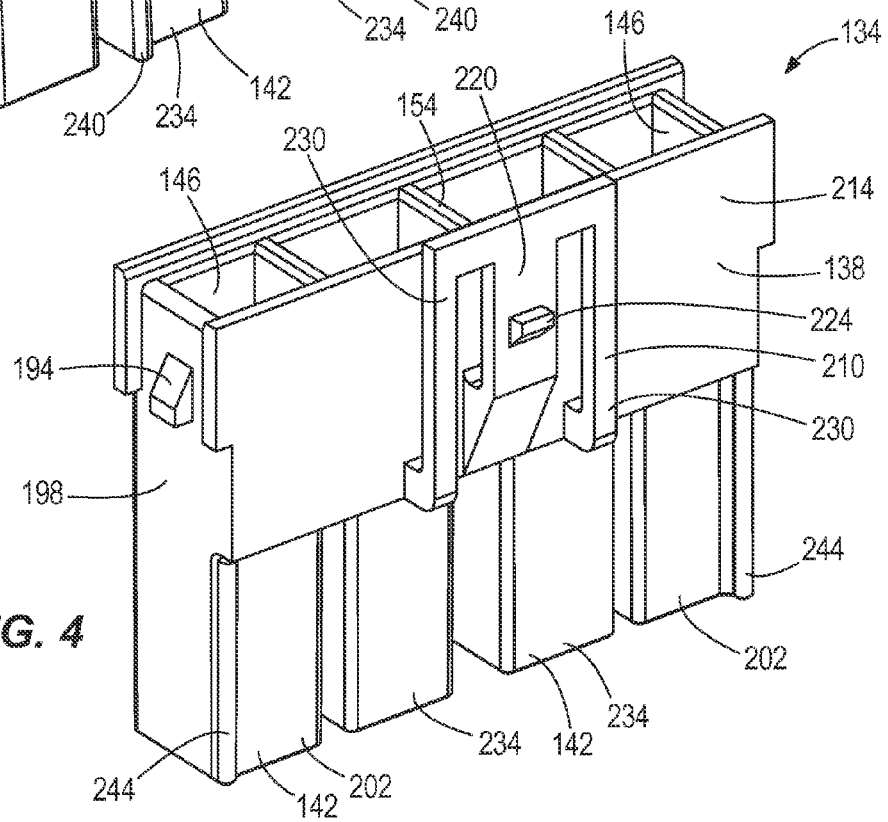
FIG. 4 is a perspective view of another 4-pin connector of the modular connector assembly of FIG. 2.
Figure 5:
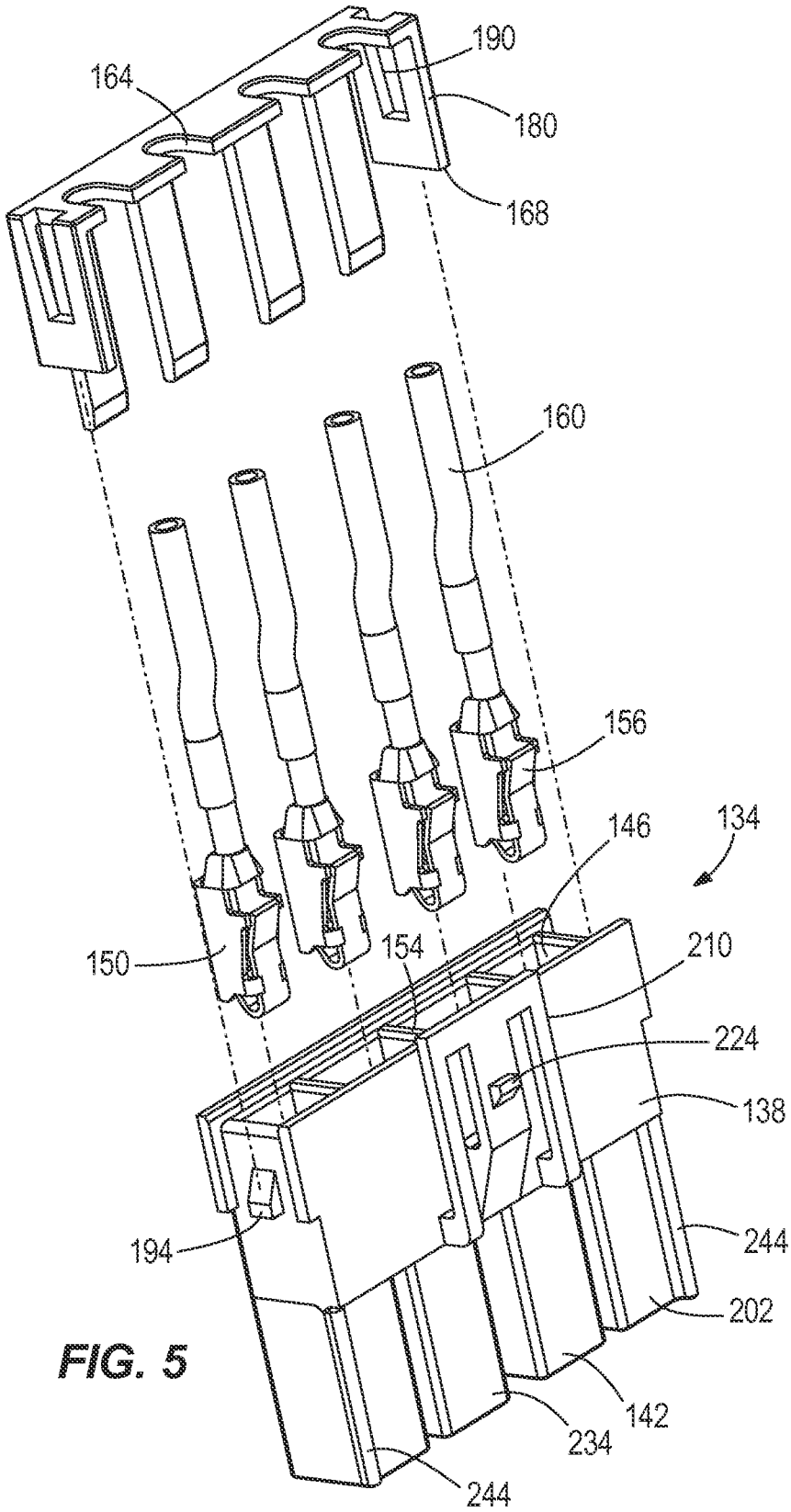
FIG. 5 is an exploded view of a 4-pin connector of the modular connector assembly of FIG. 2.

Referring to FIGS. 3, 4, and 5, a 4-pin connector 130, 134 includes a connector body 138 having four aligned connector legs 142 each defining a cavity 146 within which is disposed a connector terminal 150. A top surface 154 of the connector 130, 134 separates one cavity 146 from an adjacent cavity 146. The internal surfaces of each cavity 146 are geometrically configured to align and secure a terminal 150 during insertion, e.g., each internal surface is formed with structure that cooperates with one or more projections 156 of each terminal 150 to resist movement of the inserted terminal 150 within the respective connector leg 142. The number of terminals 150, which are known and commercially available from Delphi Corporation, is dependent on the specific fuel system application.

Conducting wires 160 extend from the terminals 150 out of the legs 142 through respective arcuate slots 164 of a retention member or clip 168. The slots 164 are spaced apart to separate the wires 160 and minimize the potential for wire wear and corrosion. The retention clip 168 includes a pair of arms 180, each defining a generally rectangular orifice 190, the arms 180 formed to resiliently deflect, pass over, and snap around a locking protrusion 194 extending from the lateral side 198 of each outer leg 202 of the connector 130, 134 to removably fasten the retention clip 168 to the connector body 138.

A cantilevered retention tab 210 integrally formed as one piece with the connector body 138 extends from an outside face 214 of the connector body 138 and comprises a medial member 220 having a centrally located catch 224 flanked by outer members 230, the operation of which will be further described below.

Referring to FIG. 3, the two inner legs 234 of the connector 130 include error-proofing ribs 240. The connector 134 of FIG. 4 differs from the connector 130 in that the two outer legs 202 of the connector 134 include error-proofing ribs 244, while the two inner legs 234 are rib-free. The ribs 240, 244, integrally formed with the connectors 130, 134, assist with alignment and correct positioning of the respective connector within a pocket body 108, as will be further explained below.

Figure 6:
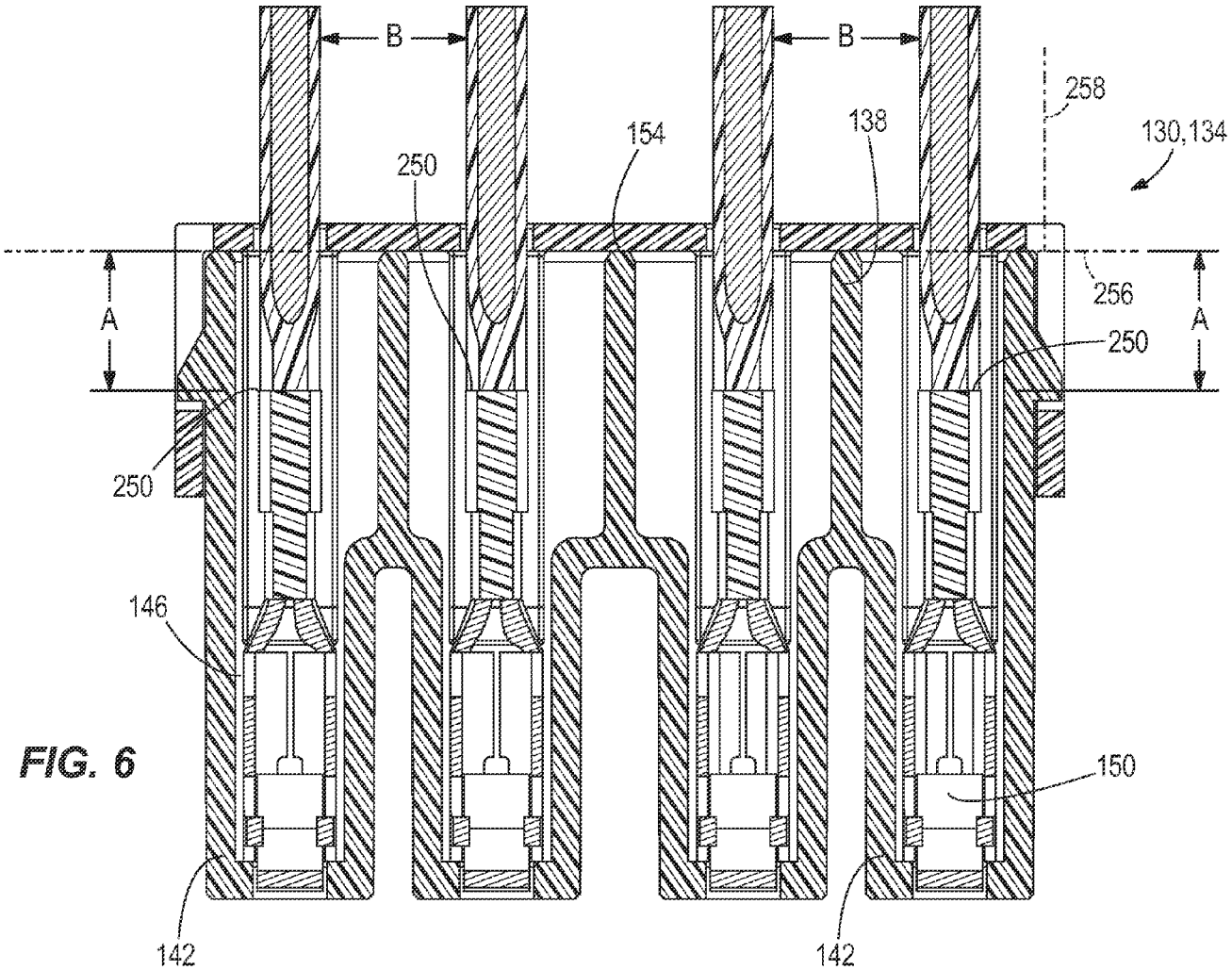
FIG. 6 is a section view of the 4-pin connector of FIG. 3 taken along line 6-6.

Referring to FIG. 6, the 4-pin connector 130, 134 in cross section illustrates the placement of each terminal 150 within the cavity of a respective leg 142. To minimize the formation of an electrical circuit (arcing) via the conductive fuel, the terminals 150 each include a terminal end 250 positioned a minimum total distance from an adjacent terminal end 250 such that no possible fluid (fuel) path from terminal end 250 to terminal end 250 spans less than a certain fluid distance. A plane 256 is defined coincident with the top surfaces 154, and a direction 258 is defined orthogonal to the plane 256. The terminal end 250 represents the closest exposed conducting surface of the terminal 150 to the plane 256. A distance "A" is defined from the terminal end 250 in the direction 258 to the plane 256. A distance "B" is defined as the distance along the plane 256 from one terminal 150 to an adjacent terminal 150, as shown in FIG. 6. The fluid distance, identified as the shortest or most direct path between the two terminal ends 250, is defined as twice distance "A" plus distance "B." For example, a minimum desired charge separation fluid distance between terminals 250 in an ethanol-based fuel application may be no less than 15 mm.

Referring to FIGS. 7-10, a 2-pin connector 270, 272, 274, 276 is configured similarly to the previously described 4-pin connectors and includes a connector body 278 having two connector legs 282, each defining a cavity 286 for a respective connector terminal. A retention clip 290 (shown only in FIGS. 7 and 8) includes a slot 294 for separating each wire 160 of a respective terminal, and a pair of arms 302 for securing the retention clip 290 to a locking projection 306 formed on the lateral outer sides 310 of the legs 282 in the manner previously described.

Figure 7:
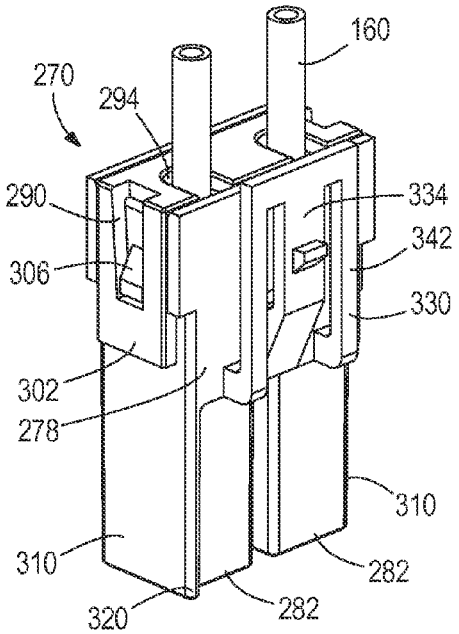
FIG. 7 is a perspective view of a 2-pin connector of the modular connector assembly of FIG. 2.
Figure 8:
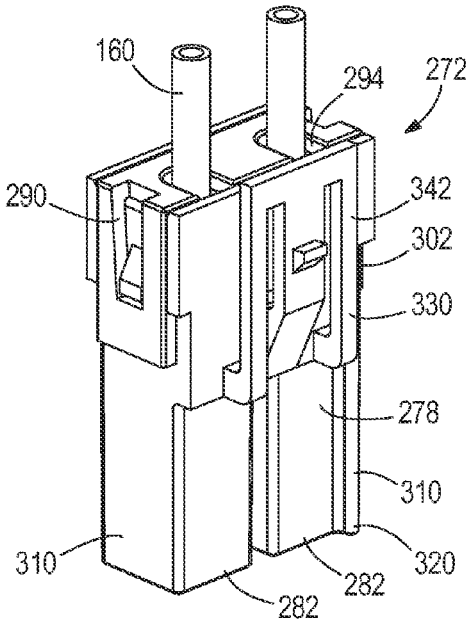
FIG. 8 is a perspective view of another 2-pin connector of the modular connector assembly of FIG. 2.
Figure 9:
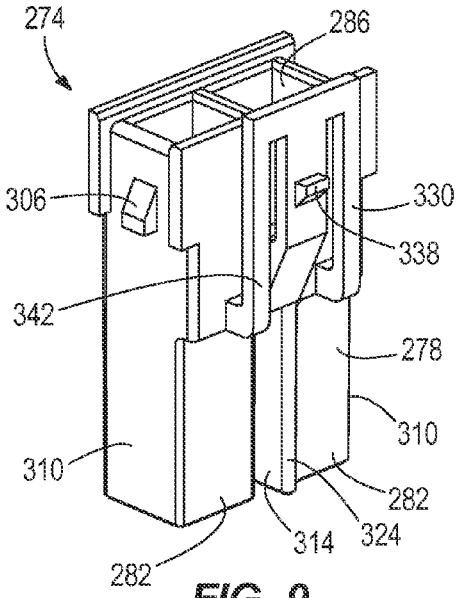
FIG. 9 is a perspective view of another 2-pin connector of the modular connector assembly of FIG. 2.
Figure 10:
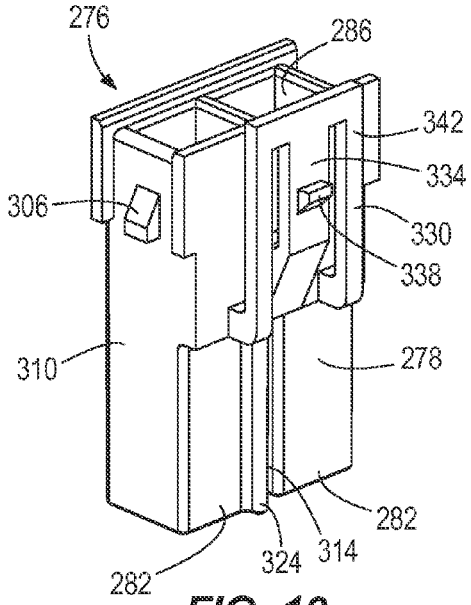
FIG. 10 is a perspective view of another 2-pin connector of the modular connector assembly of FIG. 2.

The connector 270 includes an error-proofing rib 320 on the lateral outer side 310 of one of its two legs 282, as illustrated in FIG. 7. The connector 272 includes an error-proofing rib 320 on the lateral outer side 310 of the other of its two legs 282, as illustrated in FIG. 8. Referring to FIG. 9, the connector 274 includes an error-proofing rib 324 on the lateral inner side 314 of one of its two legs 282. Referring to FIG. 10, the connector 276 includes an error-proofing rib 324 on the lateral inner side 314 of the other of its two legs 282. The 2-pin connectors are similarly configured to provide a minimum distance between the two terminal ends, i.e., twice a distance "A" plus a distance "B" as in the aforementioned 4-pin embodiment.

A retention tab 330 is integrally formed as one piece with the connector body 278 and comprises a medial member 334 having a centrally located catch 338 flanked by outer members 342, the operation of which is identical to that of retention tab 210 and will be further described below.

Figure 11:
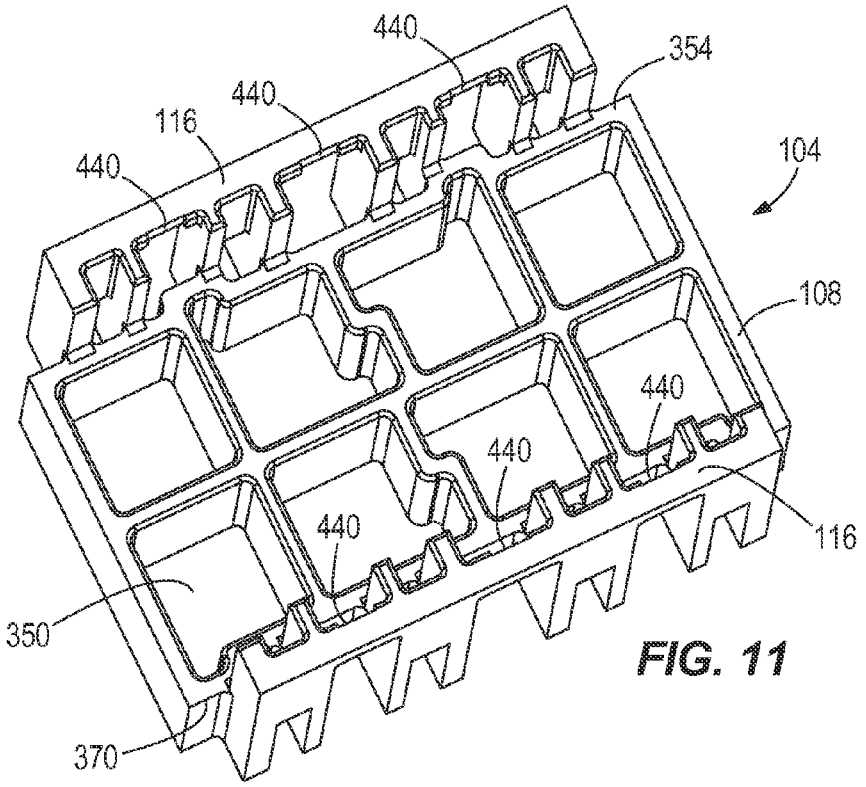
FIG. 11 is a perspective view of a pocket of the modular connector assembly of FIG. 2.
Figure 12:
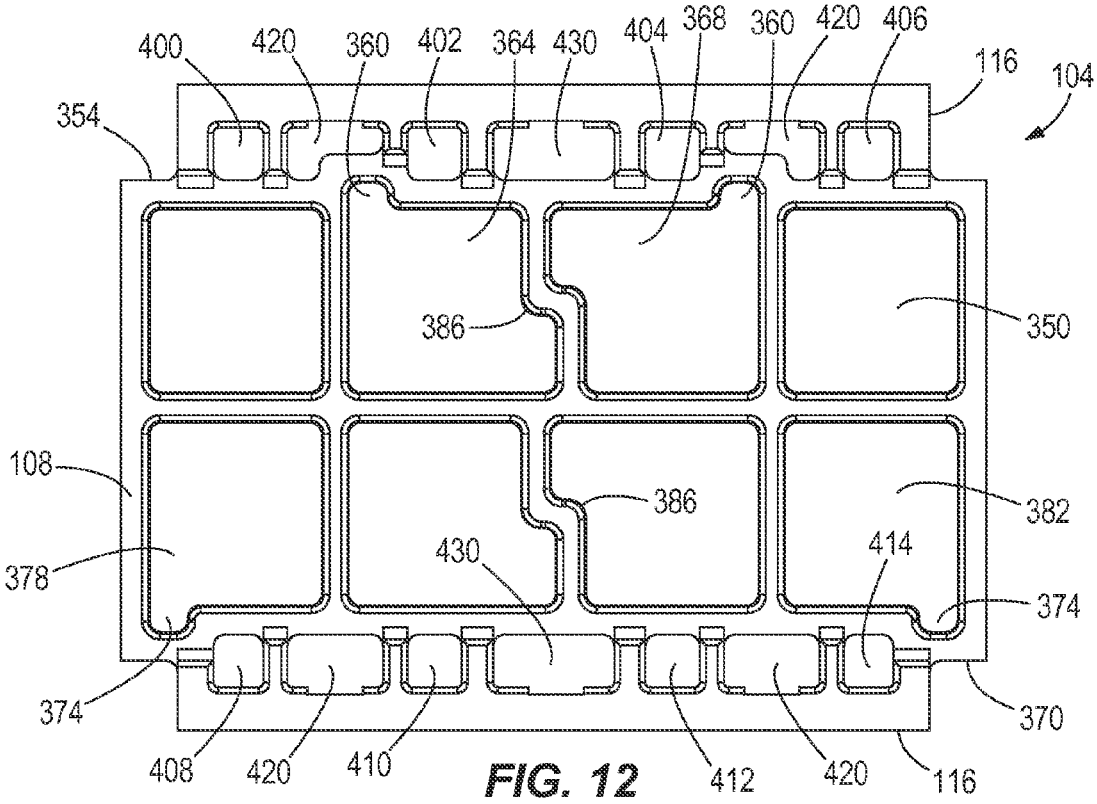
FIG. 12 is a plan view of the pocket of FIG. 11.

FIGS. 11 and 12 show a pocket 104 for retaining the connectors 130, 134, 270, 272, 274, 276. As previously described, the pocket 104 is manufactured and/or formed as part of the fuel supply module flange 102. The pocket body 108 comprises a plurality of partitioned cells 350, each sized to at least partially surround and contain a leg 142, 282 of a 2-pin connector or 4-pin connector. A first side 354 of the pocket body 108 includes a pair of rib slots 360 formed as part of two internal cells 364, 368. The cells 350 situated along the first side 354 are therefore configured to receive either the 4-pin connector 130 of FIG. 3 or the 2-pin connectors 274, 276 of FIGS. 9 and 10, singly or together. A second side 370 of the pocket body 108 includes a pair of rib slots 374 formed as part of two external cells 378, 382. The cells 350 situated along the second side 370 are therefore configured to receive either the 4-pin connector 134 of FIG. 4 or the 2-pin connectors 270, 272 of FIGS. 7 and 8, singly or together. A non-uniform center rib 386 extending from side 354 to side 370 retains a necessary overall wall thickness to permit proper spacing between the two inner legs 234 of a 4-pin connector 130, 134 and to prohibit undesirable movement between two 2-pin connectors 270, 272, 274, 278.

The first and second sides 354, 370 of the pocket 104 are integral with pocket retainers 116. Referring also to FIG. 2, the pocket retainers 116 include a series of channels 400-414. The channels 400-414 are sized and spaced to accept the outer members 230, 342 of retention tabs 210, 330. Specifically, channels 400 and 402 along the first side 354 are configured to accept the outer members 342 of the retention tab 330 of connector 276. Channels 404 and 406 along the first side 354 are configured to accept the outer members 342 of the retention tab 330 of connector 274. Channels 402 and 404 along the first side 354 are configured to accept the outer members 230 of the retention tab 210 of connector 130. Channels 408 and 410 along the second side 370 are configured to accept the outer members 342 of the retention tab 330 of connector 270. Channels 412 and 414 along the second side 370 are configured to accept the outer members 342 of the retention tab 330 of connector 272. Channels 410 and 412 along the second side 370 are configured to accept the outer members 230 of the retention tab 210 of connector 134. In the preceding configurations, the respective medial members 220, 334 are received in recesses 420, 430 between the associated channels (410-414), each having an engagement surface with an edge 440 operable to retain each respective catch 224, 338 to removably secure the connectors 130, 134, 270, 272, 274, 276 within the pocket 104.

In assembly, the terminals 150 are disposed within one or more legs 142, 282 of a connector 130, 134, 270, 272, 274, 276. The retention clip 168, 290 of the connector is snapped in place over the respective locking projections 194, 306, with the wires 160 extending through the retention clip slots 164, 294. The assembled connector 130, 134, 270, 272, 274, 276 is received within a group of two or four cells 350 of the pocket body 108 (formed as part of or with the previously described flange). Each assembled connector 130, 134, 270, 272, 274, 276 is only receivable in the pocket body 108 in a certain manner due to the cooperation of the ribs 240, 244, 320, 324 with the rib slots 360, 374. Once aligned, each connector 130, 134, 270, 272, 274, 276 is depressed to the point at which the respective catch 224, 338 extending from the medial member 220, 334 of the respective retention tab 210, 330 is retained by the edges 440 of the recesses 420, 430 of the pocket retainers 116. This secures the connectors 130, 134, 270, 272, 274, 276 to the pocket 104 and concurrently couples the terminals 150 to a plurality of corresponding male terminals overmolded in the flange.

The components of the connector assembly 100, excluding metallic conductors, are primarily formed (molded) of plastic, but other embodiments could be of any material suitable for the environment of use.

The overall interaction of the connectors 130, 134, 270, 272, 274, 276 with the pocket 104 effects an error-free method of assembling a modular connector assembly 100 while accommodating a variety of connector combinations. Connector combinations possible include one (1) 4-pin connector; two (2) 4-pin connectors; one (1) 4-pin connector and one (1) 2-pin connector; one (1) 4-pin connector and two (2) 2-pin connectors; two (2) 2-pin connectors; three (3) 2-pin connectors; and four (4) 2-pin connectors.

The modular design of the above-described connector assembly 100 is operable for packaging up to eight terminals having a minimum charge separation distance between conductors in a minimum amount of space without the use of mechanical seal elements or sealing agents during assembly. As a result, the conductors are not fluidly sealed from each other during operation. In a particular application, for example, increasing the amount of ethanol in fuel raises the overall fuel conductivity. A connector assembly designed to account for this increased conductivity without the use of the aforementioned seals or sealing agents by maintaining a minimum desired charge separation distance between the conductors of no less than, for example, 15 mm reduces manufacturing cost and assembly time.

Various features and advantages of the invention are set forth in the following claims.

The invention claimed is:

1. A modular electrical connector assembly for a fuel supply module, the assembly comprising:

an electrical connector having a first leg portion defining a first cavity configured to receive a first connector terminal having a first terminal end, and a second leg portion adjacent to the first leg portion, the second leg portion defining a second cavity configured to receive a second connector terminal having a second terminal end, the connector further having a surface separating the first cavity from the second cavity and defining a plane coincident therewith;

a receptacle including a body having one or more cells formed to receive the electrical connector; and a retention member removably coupled to the electrical connector and forming an aperture for a conducting wire of the first terminal and an aperture for a conducting wire of the second terminal, wherein when the first connector terminal is disposed within the first cavity and the second connector terminal is disposed within the second cavity, twice a shortest distance A from one of the first and second terminal ends to the plane plus a shortest distance B along the plane between the first connector terminal and the second connector terminal is no less than a predetermined distance, and wherein the first connector terminal and the second connector terminal are concurrently operable with the fuel supply module.

2. The assembly of claim 1, wherein the predetermined distance is 15 mm.

3. The assembly of claim 1, wherein the retention member includes an arm resiliently couplable to a protrusion extending from one of the first and the second leg portions.

4. The assembly of claim 1, further including a retention tab integrally formed as one piece with the electrical connector, the retention tab configured to removably secure the electrical connector to the receptacle.

5. The assembly of claim 1, wherein an internal surface of the first cavity is cooperative with a projection of the first connector terminal to hinder removal of the first connector terminal from the electrical connector.

6. The assembly of claim 1, wherein the electrical connector further includes a third leg portion defining a third cavity configured to receive a third connector terminal having a third terminal end; and a fourth leg portion adjacent to the third leg portion, the fourth leg portion defining a fourth cavity configured to receive a fourth connector terminal having a fourth terminal end, the connector further having a surface separating the third cavity from the fourth cavity coincident with the plane, wherein when the third connector terminal is disposed within the third cavity and the fourth connector terminal is disposed within the fourth cavity, twice a shortest distance A from one of the third and fourth terminal ends to the plane plus a shortest distance B along the plane between the third connector terminal and the fourth connector terminal is no less than the predetermined distance.

7. The assembly of claim 6, wherein the predetermined distance is 15 mm.

8. The assembly of claim 6, wherein the first leg portion, the second leg portion, the third leg portion, and the fourth leg portion are sequentially aligned.

9. The assembly of claim 8, wherein the second leg portion and the third leg portion each include a rib integrally formed as one piece with the electrical connector, the ribs disposed to mate with opposing slots formed in the receptacle body to uniquely position the electrical connector within the one or more cells.

10. The assembly of claim 8, wherein the first leg portion and the fourth leg portion each include a rib integrally formed as one piece with the electrical connector, the ribs disposed to mate with opposing slots formed in the receptacle body to uniquely position the electrical connector within the one or more cells.

11. A modular electrical connector assembly for a fuel supply module, the assembly comprising:

an electrical connector having a first leg portion defining a first cavity configured to receive a first connector terminal having a first terminal end, and a second leg portion adjacent to the first leg portion, the second leg portion defining a second cavity configured to receive a second connector terminal having a second terminal end, the connector further having a surface separating the first cavity from the second cavity and defining a plane coincident therewith; and a receptacle including a body having one or more cells formed to receive the electrical connector, wherein when the first connector terminal is disposed within the first cavity and the second connector terminal is disposed within the second cavity, twice a shortest distance A from one of the first and second terminal ends to the plane plus a shortest distance B along the plane between the first connector terminal and the second connector terminal is no less than a predetermined distance, and wherein the first connector terminal and the second connector terminal are concurrently operable with the fuel supply module, wherein one of the first leg portion and the second leg portion includes a single rib integrally formed as one piece with the electrical connector, the rib disposed to mate with an opposing slot formed in the receptacle body to position the electrical connector within the one or more cells.

12. The assembly of claim 11, wherein each leg portion includes an inner side and an opposing outer side, the inner side of the first leg portion facing the inner side of the second leg portion, and wherein the rib extends from the outer side of one of the first leg portion and the second leg portion.

13. The assembly of claim 1, wherein the electrical connector is a first electrical connector further including a third leg portion defining a third cavity configured to receive a third connector terminal and a fourth leg portion defining a fourth cavity configured to receive a fourth connector terminal, the assembly further including a second electrical connector having a first leg portion defining a fifth cavity configured to receive a fifth connector terminal and a second leg portion defining a sixth cavity configured to receive a sixth connector terminal, wherein the one or more cells are formed to simultaneously receive the first electrical connector and the second electrical connector.

14. The assembly of claim 13, further including a third electrical connector having a first leg portion defining a seventh cavity configured to receive a seventh connector terminal and a second leg portion defining an eighth cavity configured to receive an eighth connector terminal, wherein the one or more cells are formed to simultaneously receive the first, second, and third electrical connectors.

15. The assembly of claim 1, wherein the assembly is free of a seal fluidly separating the first cavity from the second cavity.

16. The assembly of claim 11, wherein each leg portion includes an inner side and an opposing outer side, the inner side of the first leg portion facing the inner side of the second leg portion, and wherein the rib extends from the inner side of one of the first leg portion and the second leg portion.

17. A modular electrical connector assembly for a fuel supply module, the assembly comprising:

an electrical connector having a first leg portion defining a first cavity configured to receive a first connector terminal having a first terminal end, and a second leg portion adjacent to the first leg portion, the second leg portion defining a second cavity configured to receive a second connector terminal having a second terminal end, the connector further having a surface separating the first cavity from the second cavity and defining a plane coincident therewith;

a receptacle including a body having one or more cells formed to receive the electrical connector;

a third leg portion defining a third cavity configured to receive a third connector terminal having a third terminal end; and a fourth leg portion adjacent to the third leg portion, the fourth leg portion defining a fourth cavity configured to receive a fourth connector terminal having a fourth terminal end, the connector further having a surface separating the third cavity from the fourth cavity coincident with the plane, wherein the first leg portion, the second leg portion, the third leg portion, and the fourth leg portion are sequentially aligned, wherein when the first connector terminal is disposed within the first cavity and the second connector terminal is disposed within the second cavity, twice a shortest distance A from one of the first and second terminal ends to the plane plus a shortest distance B along the plane between the first connector terminal and the second connector terminal is no less than a predetermined distance, and wherein the first connector terminal and the second connector terminal are concurrently operable with the fuel supply module, wherein when the third connector terminal is disposed within the third cavity and the fourth connector terminal is disposed within the fourth cavity, twice a shortest distance A from one of the third and fourth terminal ends to the plane plus a shortest distance B along the plane between the third connector terminal and the fourth connector terminal is no less than the predetermined distance, and wherein the second leg portion and the third leg portion, or the first leg portion and the fourth leg portion, each include a rib integrally formed as one piece with the electrical connector, the ribs disposed to mate with opposing slots formed in the receptacle body to uniquely position the electrical connector within the one or more cells.

* * * * *